US006718883B2

(12) United States Patent
Duparc et al.

(10) Patent No.: US 6,718,883 B2
(45) Date of Patent: Apr. 13, 2004

(54) DEVICE FOR NEUTRALIZING A PAYLOAD

(75) Inventors: Jean-paul Duparc, Bourges (FR); Michel Vives, Saint-Amboix (FR); Patrick Silvain, Bourges (FR)

(73) Assignee: Giat Industries, Versailles (FR)

( * ) Notice: Subject to any disclaimer, the term of this patent is extended or adjusted under 35 U.S.C. 154(b) by 0 days.

(21) Appl. No.: 10/069,021

(22) PCT Filed: Jul. 17, 2001

(86) PCT No.: PCT/FR01/02317

§ 371 (c)(1),
(2), (4) Date: Feb. 21, 2002

(87) PCT Pub. No.: WO02/08684

PCT Pub. Date: Jan. 31, 2002

(65) Prior Publication Data

US 2002/0134271 A1 Sep. 26, 2002

(30) Foreign Application Priority Data

Jan. 26, 2000 (FR) ..... 00 09813

(51) Int. Cl.[7] ..... F42B 15/00; F42B 10/34
(52) U.S. Cl. ..... 102/374; 102/476
(58) Field of Search ..... 102/374, 476

(56) References Cited

U.S. PATENT DOCUMENTS 3,382,800 A * 5/1968 Biggs, Jr. ..... 102/6
3,707,918 A * 1/1973 Dunfee et al. ..... 102/370
3,712,229 A * 1/1973 Schock ..... 102/489
3,913,483 A * 10/1975 Wolterman ..... 102/476
3,995,549 A * 12/1976 Mullen, Jr. ..... 102/476
4,459,915 A 7/1984 Lynch
4,488,489 A * 12/1984 Schoffl ..... 102/350
H345 H * 10/1987 Williamsen et al. ..... 102/476
4,961,382 A * 10/1990 Bai et al. ..... 102/476
5,203,844 A * 4/1993 Leonard ..... 244/158 R
5,271,330 A * 12/1993 Keller ..... 102/374
5,507,231 A 4/1996 Moore et al.
5,565,647 A * 10/1996 Kerdraon et al. ..... 102/476
5,760,330 A * 6/1998 Himmert et al. ..... 102/337
5,864,086 A * 1/1999 Ettmuller ..... 102/357
6,279,482 B1 * 8/2001 Smith et al. ..... 102/357

FOREIGN PATENT DOCUMENTS

DE 2 307 581 2/1973
GB 1 513 745 5/1975

* cited by examiner

*Primary Examiner*—Michael J. Carone
*Assistant Examiner*—Bret Hayes

(57) ABSTRACT

A neutralization device for a payload carried by a vector, such as a rocket. This device incorporates at least one explosively-formed charge, where such charge is made integral with the vector by a positioning device ensuring the orientation of its direction of action towards the payload.

15 Claims, 2 Drawing Sheets

DEVICE FOR NEUTRALIZING A PAYLOAD

BACKGROUND OF THE INVENTION

1. Field of Invention

The technical scope of the invention is that of devices to neutralise a payload carried by a vector.

2. Description of Related Art

Payloads thus carried may be hazardous or toxic. It is thus necessary for them to be destroyed in the event of their vector having a mishap during its flight.

Thus, the satellites that are carried on-board ballistic rockets generally incorporate extremely toxic and explosive (hydrazine, nitrogen peroxide) liquid boosters. These boosters must at all costs be destroyed in the event of an incident so as to prevent a large quantity of these materials from falling to the ground.

In practical terms, the booster casings are destroyed so as to release the ergols. The latter are destroyed by mutual contact with one another as well as by contact with the atmosphere.

It is known to implement inside rockets powder cannons firing one or several piercing projectiles in the direction of the boosters.

Such a solution is costly, cumbersome and onerous.

It requires explosive projectiles to be produced that have safety systems and delay devices.

The weapon itself is, moreover, a complex mechanism subject to failure when the rocket is launched.

The reliability of such systems is thus reduced.

The implementation of shaped charges or explosive charges has been proposed to ensure the destruction of the boosters.

However, these charges must be positioned near to, or even in contact with, the boosters to be destroyed.

Thereafter, the problem of integration into the vector is posed. Moreover, shaped charge jets have reduced effectiveness against liquid ergol boosters. The jet is rapidly consumed by the liquid and the diameter of the evacuation holes made is reduced (around a few mm).

Lastly, the geometry of the payload (satellite) may strongly differ from one vector firing to another.

The boosters are thus not placed in the same places and the vector must be modified in depth to enable a new system of neutralisation to be installed.

SUMMARY OF THE INVENTION

An object of the invention is to present a neutralisation device that does not suffer from such drawbacks.

Thus, the neutralisation device according to the invention permits the simple and reliable destruction of a payload carried by a vector.

This device may be easily adapted to different types of payload, it thus enables the vector to be more simply adapted to the charge to be carried.

Thus, the invention relates to a neutralisation device for a payload carried by a vector, such as a rocket, wherein it incorporates at least one explosively-formed charge, such charge made integral with the vector by a positioning device ensuring the orientation of its direction of action towards the payload.

Advantageously, the positioning device may be adjustable so as to allow the neutralisation device to be adapted to different structures and/or locations of the payload.

The positioning device may be immobile.

The neutralisation device may incorporate at least two explosively-formed charges.

The explosively-formed charge or charges will preferably be of a calibre greater than 50 mm.

The neutralisation device according to the invention applies more particularly to the destruction of the booster or boosters of a satellite carried on board a rocket.

BRIEF DESCRIPTION OF THE DRAWINGS

The invention will be better understood after reading the following description of a particular embodiment, such description being made in reference to the appended drawings, in which.

DETAILED DESCRIPTION OF PREFERRED EMBODIMENTS

Figure 1:
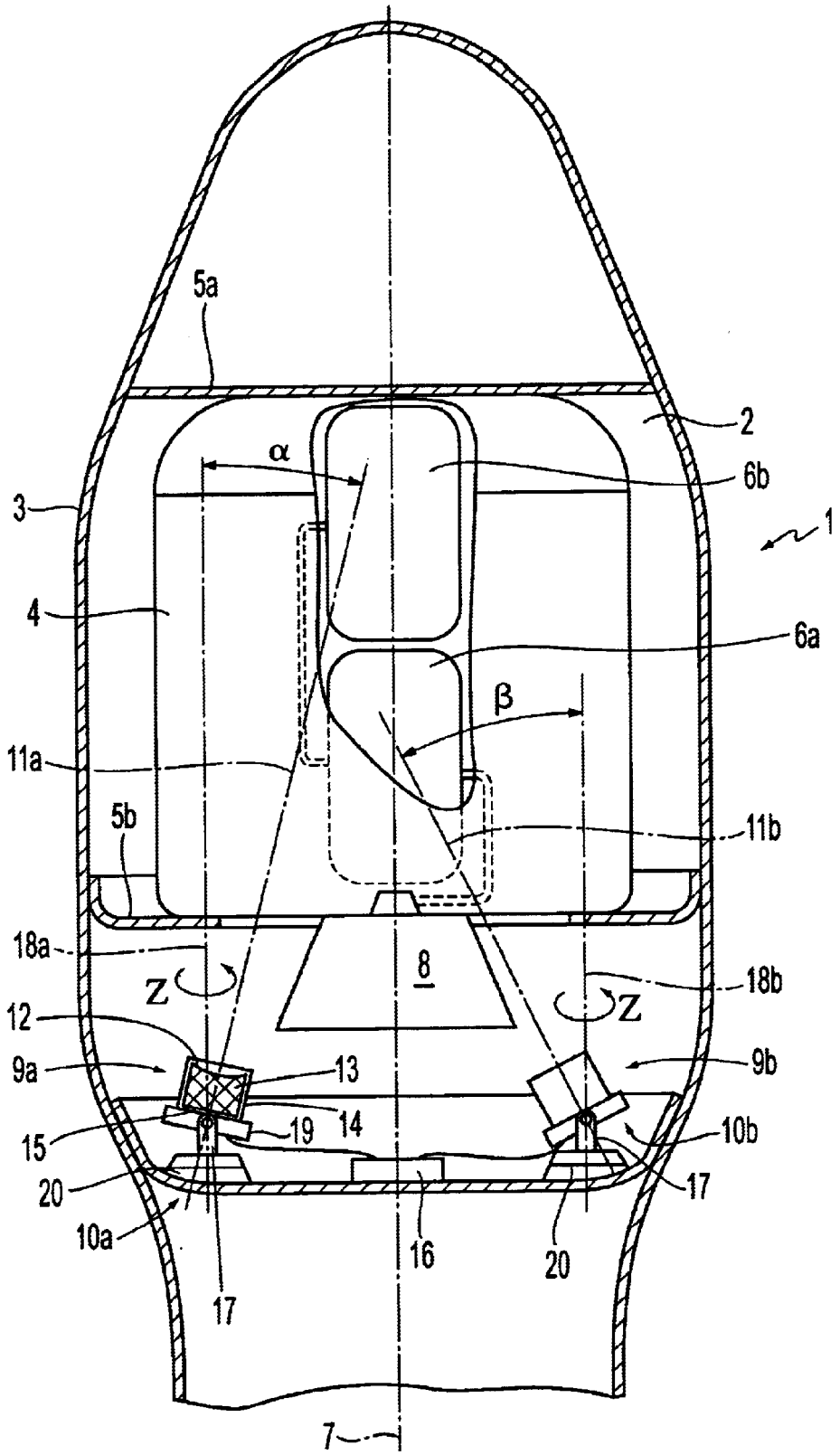
FIG. 1 schematises a partial view of a rocket carrying a satellite and equipped with a neutralisation device according to the invention.

With reference to FIG. 1, a vector 1 such as a ballistic rocket (only the head of which is shown) incorporates a housing 2 inside its nose cone 3, such housing accommodating a payload 4 formed by a satellite.

The satellite 4 is linked to the vector's nose cone by flanges 5*a*, 5*b*. In a known manner, it is intended to be released during the trajectory by the rocket at a given altitude thus ensuring it is put into orbit around the earth.

The means ensuring the opening of the nose cone and the release of the satellite have not been shown here and they do not form part of the present invention.

The satellite 4 encloses one or several tanks of liquid ergol. The satellite shown in FIG. 1 incorporates two superimposed tanks 6*a* and 6*b* and arranged substantially along the axis 7 of the rocket.

The tanks 6*a*, 6*b* are connected to a nozzle 8.

According to the invention, a neutralisation device is provided to neutralise the ergols contained in tanks 6*a*, 6*b* by fracturing the tanks thereby releasing the ergols.

The neutralisation device is automatically triggered in the event of an incident with the rocket and, for example, at the same time as conventional means ensuring the self-destruction of the rocket itself.

The neutralisation device incorporates two explosively-formed explosive charges 9*a*, 9*b*. Each charge 9*a*, 9*b* is made integral with the rocket 1 by a positioning device 10*a*, 10*b* enabling the direction of action 11*a*, 11*b* of the charge to be oriented towards the payload 4.

Explosively-formed charges are well known to the expert. Reference may be made, for example, to patents FR2627580, FR2740212 and FR2741142 that describe such a charge. They comprise an explosive charge 13 placed in a casing 14 onto which a cap-shaped metallic liner 12 is applied.

The explosive charge 13 is ignited by detonating means 15 connected to control means 16.

The positioning device 11*a*, 11*b* described here are designed so as to give one or two degrees of freedom to the casing 14 of the charge they are supporting.

It is thus possible to orient the direction of action 11*a*, 11*b* of the charge in question (that is here the same as the axis of the charge casing 14) in any way with respect to the axis 7 of the rocket.

By way of example, positioning devices can be made that comprise a stirrup 17 defining a direction 18*a*, 18*b* parallel to axis 7 of the rocket. This stirrup will be mounted pivoting with respect to a base 20 fastened to the rocket. Pivoting will thus take place around the direction 18*a* or 18*b* (arrow Z).

The charge 9*a*, 9*b* will be attached inside the stirrup 17 by a socket 19 and it will be possible to rock itself with respect to the stirrup 17.

Thus, these positioning devices allow each charge 9*a*, 9*b* to be given an optimal orientation that will be adapted to the nature and structure of the payload 4. In practical terms, each charge will be inclined such that its direction of action 11*a*, 11*b* encounters one of the tanks 6*a*, 6*b* of the satellite 4.

By way of a variant, the stirrup 17 can be immobile with respect to the base 20, the only degree of freedom of the charge will in this case be its tilting with respect to the stirrup 17.

The charge 9*a* will thus have a direction of action 11*a* that is inclined at an angle a with respect to direction 18*a* parallel to the axis 7 of the rocket 1. This direction of action 11*a* encounters the upper tank 6*b*.

Charge 9*b* has a direction of action 11*b* that is inclined at an angle β with respect to the direction 18*b* parallel to the axis 7 of the rocket 1. This direction of action 11*b* encounters the lower tank 6*a*.

Charges 9*a* and 9*b* are connected to control devices 16 intended to cause their ignition at a given time. These control devices may advantageously be formed by part of the control/guidance electronics of the rocket.

The ignition of the charge or charges 9*a*, 9*b* will be triggered during the trajectory at a given time. This ignition may advantageously be remote-controlled from the ground in the event of a major event (fracture of the rocket, lost trajectory) being detected.

Ignition may also be automatically triggered by the rocket electronics in the event of the ground communications link being lost (loss of guidance and/or control).

Charges 9*a*, 9*b* have a diameter of around 50 to 150 mm (for example 80 mm). Their liner may be made of iron or nickel. Further to their ignition they generate a slug of homokinetic metal of around 100 g moving at a velocity of around 2000 m/s.

Such a slug is stable up to a range of around 25 m, than is up to a range far greater than the maximum distance separating the charge from one of the ergol tanks.

The piercing capacities of these slugs are practically undisturbed by metallic or composites sheeting or other protection surrounding the satellite.

The tanks 6*a*, 6*b* are therefore pierced by the slugs thus generated. This results in a dynamic overpressure that causes the tanks to explode.

We can see that the device according to the invention may be placed in the rocket at a relative distance from the payload. The velocity and stability of the slugs ensures the reliable destruction of the payload despite this distance.

Nor is it necessary for the payload structure to be modified, the slugs being sufficiently stable and energetic to ensure the neutralisation of the tanks through the satellite walls.

Doted with a simple, compact, and easily integratable structure, the device according to the invention thus allows the certain destruction of the payload and notably of the liquid ergols enclosed in the tanks 6*a*, 6*b*. The reliability of the device is greater than that of existing devices and at a lower cost.

Figure 2:
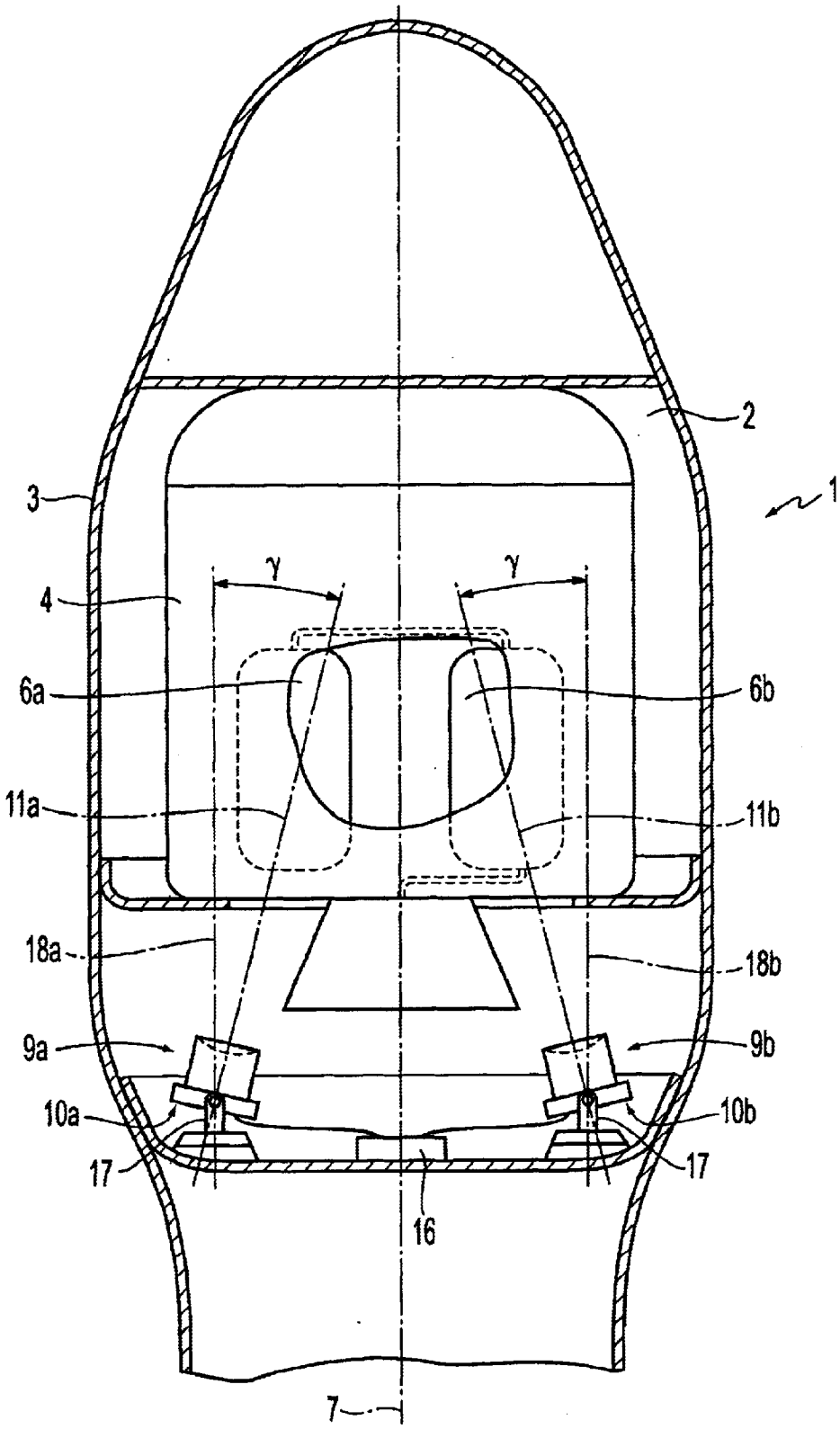
FIG. 2 is a view of the same rocket carrying a satellite that has a different internal structure.

FIG. 2 shows a rocket 1 that is identical to the one previously described but which carries a satellite 4 of a different structure.

This satellite incorporates two tanks 6*a*, 6*b* of ergols that are arranged in parallel to one another on either side on the axis 7.

The positioning devices 10*a*, and 10*b* allow the orientation of the directions of action 11*a* and 11*b* of the charges to be modified such that each direction of action encounters a tank 6*a* or 6*b*.

Here, because of the symmetrical positioning of the tanks 6*a* and 6*b* with respect to the axis 7, the directions of action 11*a* and 11*b* are inclined at the same angle γ with respect to the directions 18*a*, 18*b* defined by the stirrups 17 and parallel to the axis 7 of the rocket 1.

We can thus see that thanks to the invention it is easy for the neutralisation device to be adapted to the structure of a given payload.

The charges will be adjusted when the payload is integrated.

By way of a variant, a different number of charges may naturally be provided.

Immobile, non-adjustable positioning devices may also be provided ensuring a given orientation for a given direction of action of each charge.

What is claimed is:

1. A neutralisation device for a payload carried by a vector, the neutralization device comprising:

at least one shape explosive charge with a liner, the liner forming a projectile upon detonation of the shape explosive charge, each such shape explosive charge mounted within the vector by a corresponding positioning unit ensuring the orientation of the charge's detonation propels the projectile along a direction of action towards the payload.

2. The neutralisation device according to claim 1, wherein each positioning unit is adjustable so as to allow the neutralisation device to be adapted to different structures and/or locations of the payload.

3. The neutralisation device according to claim 1, wherein each positioning unit is immobile.

4. The neutralisation device according to claim 1, wherein the at least one shape explosive charge comprises at least two shape explosive charges.

5. The neutralisation device according to claim 1, wherein the at least one shape explosive charge is of a calibre greater than 50 mm.

6. Application of a neutralisation device according to claim 1 to the destruction of each booster of the payload carried on board the vector.

7. The neutralisation device according to claim 2, wherein the at least one shape explosive charge comprises at least two shape explosive charges.

8. The neutralisation device according to claim 3, wherein the at least one shape explosive charge comprises at least two shape explosive charges.

9. The neutralisation device according to claim 2, wherein each shape explosive charge is of a calibre greater than 50 mm.

10. The neutralisation device according to claim 3, wherein each shape explosive charge is of a calibre greater than 50 mm.

11. The neutralisation device according to claim 4, wherein each shape explosive charge is of a calibre greater than 50 mm.

12. Application of a neutralisation device according to claim 2 to the destruction of each booster of the payload carried on board the vector.

13. Application of a neutralisation device according to claim 3 to the destruction of each booster of the payload carried on board the vector.

14. Application of a neutralisation device according to claim 4 to the destruction of each booster of the payload carried on board the vector.

15. Application of a neutralisation device according to claim 5 to the destruction of each booster of the payload carried on board the vector.

* * * * *

UNITED STATES PATENT AND TRADEMARK OFFICE

CERTIFICATE OF CORRECTION

PATENT NO. : 6,718,883 B2 
DATED : April 13, 2004
INVENTOR(S) : Jean-paul Duparc, Michel Vives and Patrick Silvain It is certified that error appears in the above-identified patent and that said Letters Patent is hereby corrected as shown below:

Title page,
Item [30], Foreign Application Priority Data, please change
"Jan. 26, 2000 (FR) ……...00 09813" to
-- July 26, 2000 (FR) ……...00 09813 --

Signed and Sealed this

Fifth Day of July, 2005

JON W. DUDAS
*Director of the United States Patent and Trademark Office*